US006599080B1

(12) United States Patent
Karlsson

(10) Patent No.: US 6,599,080 B1
(45) Date of Patent: Jul. 29, 2003

(54) LIFTING DEVICE FOR RAILWAY VEHICLES

(75) Inventor: Willy Karlsson, Kalmar (SE)

(73) Assignee: Daimler Chrysler AG, Stuttgart (DE)

( * ) Notice: Subject to any disclaimer, the term of this patent is extended or adjusted under 35 U.S.C. 154(b) by 0 days.

(21) Appl. No.: 09/646,987

(22) PCT Filed: Mar. 17, 1999

(86) PCT No.: PCT/SE99/00409

§ 371 (c)(1),
(2), (4) Date: Dec. 1, 2000

(87) PCT Pub. No.: WO99/48458

PCT Pub. Date: Sep. 30, 1999

(30) Foreign Application Priority Data

Mar. 26, 1998 (SE) ..... 9801019

(51) Int. Cl.[7] ..... A61G 3/00; A61G 3/06

(52) U.S. Cl. ..... 414/663; 414/540; 414/545; 414/672; 414/921; 105/375; 105/425; 105/443

(58) Field of Search ..... 254/2 R; 414/665, 414/672, 669, 539, 540, 545, 921, 663; 105/329.1, 375, 443, 341, 425, 430, 429; 104/35; 187/200

(56) References Cited

U.S. PATENT DOCUMENTS 4,441,850 A * 4/1984 Thorley ..... 414/545
5,205,697 A * 4/1993 Getty et al. ..... 414/921 X
5,230,288 A 7/1993 Bickel
5,281,017 A * 1/1994 Geiss, II ..... 414/921 X
5,357,869 A 10/1994 Barjolle et al.
5,553,990 A * 9/1996 Kytola, Sr. ..... 414/659
5,632,357 A * 5/1997 Matre ..... 187/200

FOREIGN PATENT DOCUMENTS

JP 402056392 * 2/1990 ..... 187/401
JP 7-304579 11/1995

* cited by examiner

*Primary Examiner*—Steven A. Bratlie
(74) *Attorney, Agent, or Firm*—Connolly Bove Lodge & Hutz LLP

(57) ABSTRACT

In a device for transfering especially a person sitting in a wheel-chair between a platform and a passenger department of a vehicle having a floor on a higher level than the platform a first floor surface (5) is arranged inside the vehicle closest to an entrance (2) into the vehicle from a platform side and arranged on substantially the same level as the platform. Power means are adapted to move a support surface (6) arranged inside the vehicle and reachable through the first floor surface (5) between platform level and the level of the floor of the passenger department so as to join a first floor surface and a second floor surface (10) leading to the passenger department or belonging thereto, respectively. A staircase (8) is arranged between the two levels beside the support surface (6) and directly reachable through the first floor surface (5) as well as the second floor surface (10) independently of the position of the support surface (6).

21 Claims, 3 Drawing Sheets

LIFTING DEVICE FOR RAILWAY VEHICLES

FIELD OF THE INVENTION AND PRIOR ART

The present invention relates to a device for transfering especially passengers with a reduced ability to move, primarily sitting in wheelchairs between a platform and a passenger department of a vehicle having a passenger department with a floor on a first level being higher than a second level, corresponding to the platform level when the vehicle is standing adjacent to a platform, by at least a normal height of a stair, in which it comprises an arrangement adapted to receive a passenger on a support surface and power means adapted to move said support surface between the two levels, and in which one or several stairs are arranged so as to allow other passengers to go between the different levels by themselves.

Devices of this type are mainly used for making it possible for persons sitting in a wheelchair to get off and get on railway carriages or cars having said difference in level between the floor of the passenger department and the platform, so that this particular application will be discussed hereinafter for illuminating but not at all restricting the invention. When there is such a level difference, which is the case in most railway carriages, between the floor of a passenger department, i.e. a passenger carriage, and a platform plane, difficulties arise when passengers sitting in a wheelchair are going to get on and off the train.

It is impossible for a person sitting in a wheelchair to move between the two levels without any type of lifting device, and devices of the type defined in the introduction are therefor arranged in certain railway carriages. A support plane having a said support surface projectable at a door opening into the railway carriage in question is arranged in these carriages, where also a staircase is leading from a railway carriage down to the platform, and the support plane may be lowered down to the platform so that a person sitting in a wheelchair can roll on to the supporting plane, whereupon this can be lifted to the same level as the door opening, so that the person may roll in with the wheelchair on to the floor located on the first level. A disadvantage of these devices already known is that, when the arrangement is used for moving the person sitting in a wheelchair between the two levels, this arrangement blocks the staircase leading between the two levels, so that the other passengers may not get on or off the train and the door opening in question as long as the lifting arrangement is used, but this has to be pivoted entirely away or be drawn in before other may pass the door opening, which may be very disturbing.

SUMMARY OF THE INVENTION

The object of the present invention is to provide a device of the type defined in the introduction, which finds a remedy to the inconveniences of such devices already known.

This object is according to the invention obtained by the fact that a first floor surface inside the vehicle closest to an entrance into the vehicle from a platform side is arranged substantially on said second level, that the power means are adapted to move said support surface between said two levels so as to join a first floor surface on the second level and on the first level join a second floor surface leading to the passenger department and belonging thereto, the arrangement is arranged with the support surface thereof at a distance from said entrance inside the vehicle and having this reachable from the entrance through said first floor surface, and a staircase between the second and the first level is arranged beside the support surface of the arrangement and directly reachable through said first floor surface as well as said second floor surface independently of the position of the support surface.

By arranging a first floor surface located on the second level, i.e. the platform level, in this way inside the vehicle and the arrangement with the support surface thereof inside the vehicle at a distance from the entrance and reachable from the entrance through the first floor surface as well as a staircase between the second and the first level beside the support surface of the arrangement and directly reachable through said first floor surface as well as said second floor surface independently of the position of the support surface, a free passage for other passengers into and out of the vehicle and between platform level and passenger department level is achieved independently of whether any passenger sitting in a wheelchair for the moment is occupied with moving between said two levels, so that the actions taken by this person not in any way disturb the other passengers and the latters are neither in the way of the person sitting in the wheelchair.

According to a preferred embodiment of the invention the vehicle has said entrances on both sides thereof and the arrangement is arranged with said support surface in a mid region between the two entrances and reachable from both these entrances through said first floor surface with a staircase leading from a first and a second floor surface on each side of said support surface laterally between the entrance and the support surface. A free passage on both sides of the lifting arrangement for other passengers between the two levels is obtained by this, i.e. independently of which entrance is utilised at a given moment, i.e. on which side of the train the platform is located, and the person in the wheelchair may get into the train from both sides and reach the support surface so as to move to the passenger department floor surface. The corresponding discussion is of course valid for getting off case.

According to another preferred embodiment of the invention the support surface is turnable about a substantially vertical axis. It is by this possible that for example a wheelchair with a passenger sitting in it may be driven on to the support surface with an orientation not matching the orientation the wheelchair should have when the lifting or the lowering between the two levels has been carried out, since a turning of the support surface in connection with this lifting or lowering may take care of this discrepancy.

According to another preferred embodiment of the invention, which constitutes a further development of the embodiment last mentioned, the device comprises power means controllable to cause optional turning of said support surface so as to change the orientation of a passenger resting on the support surface upon transfer thereof between the two levels. It is a matter of course that it is an advantage that the turning may take place through an optionally controllable power means.

According to another preferred embodiment of the invention said power means for turning are adapted to cause turning of the support surface by substantially 90° so as to make it possible to get on and get off the support surface in a substantially transversal direction on said second level and a substantially longitudinal direction on said first level with respect to the driving direction of the railway vehicle. This is very advantageous, since it is suitable to get into and out of for example a railway carriage straight from the side, i.e. in said transversal direction, but after that move in the carriage in the longitudinal direction thereof, i.e. in said longitudinal direction. A direction change desired at a transfer between the two levels is according to this embodiment achieved in a comfortable way.

According to another preferred embodiment of the invention said power means for the turning movement is arranged to automatically cause a turning of a support surface by substantially 90° in connection with said transfer between the two levels. An optimum orientation of for example a wheelchair with respect to the respective level is by this obtained in a comfortable way and automatically.

According to another preferred embodiment of the invention said power means for the turning movement may be optionally actuated to turn the support surface into one or the other direction depending upon on which side of the vehicle a platform for getting off/getting on is located in connection with movement of the support surface in the vertical direction between the first level and the second level. A correct adaption of the orientation of a wheelchair located on the support surface independently of the direction from which it has been rolled on to the support surface or in which direction this is intended to be rolled off the support surface is obtained by this.

According to another preferred embodiment of the invention the device comprises operating means for controlling the arrangement, which may be actuated by a said passenger having a reduced ability to move. The operation or control of the device according to the invention is by this simplified substantially, since no train staff is needed for this, which is the case for the devices already known of this type, since they are so configurated that the person sitting in the wheelchair may not reach the operating means, and it is neither desirable that this could take place as a consequence of the accidents which could be a result thereof.

According to another preferred embodiment of the invention the device comprises a footbridge-like member projectable from the vehicle at said entrance on substantially the same level as the first support floor surface for at least partially bridging the gap between said first support floor surface and an adjacent platform when the vehicle is standing at a platform. The rolling on and off of a person sitting in a wheelchair onto and off, respectively, the vehicle is by this facilitated.

According to another preferred embodiment of the invention said support surface is substantially circle round. Such a design of the support surface has turned out to be advantageous, since it is desired that the support surface should be turnable, and the co-operation with the surrounding floor surfaces gets very advantageous for such a shape of the support surface for such turning.

According to another preferred embodiment of the invention the staircase has three stairs. This is advantageous, since level differences between the platform and the floor surface of the passenger department normally are such that three stairs are suitable.

Further advantages as well as advantageous features of the invention will appear from the following description and the other dependent claims.

BRIEF DESCRIPTION OF THE DRAWINGS

With reference to the appended drawings, below follows a description of a preferred embodiment of the invention cited as an example.

In the drawings.

DETAILED DESCRIPTION OF A PREFERRED EMBODIMENT OF THE INVENTION

Figure 1:
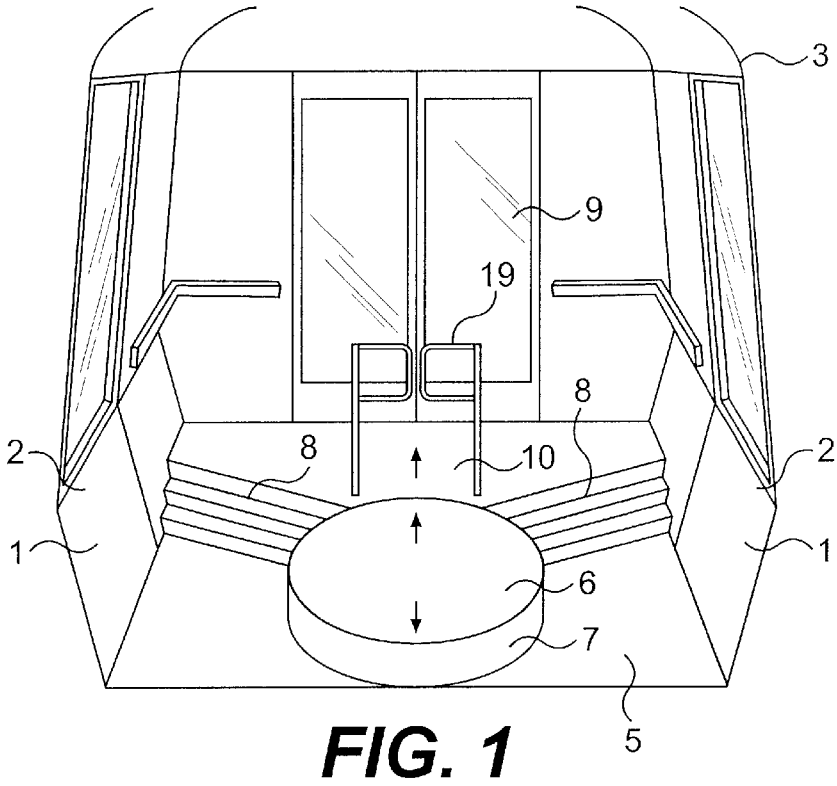
FIG. 1 is a perspective view of a device according to a preferred embodiment of the invention with the support surface of a lifting device included therein on a raised level, i.e. on the same level as the floor surface of the passenger department.
Figure 2:
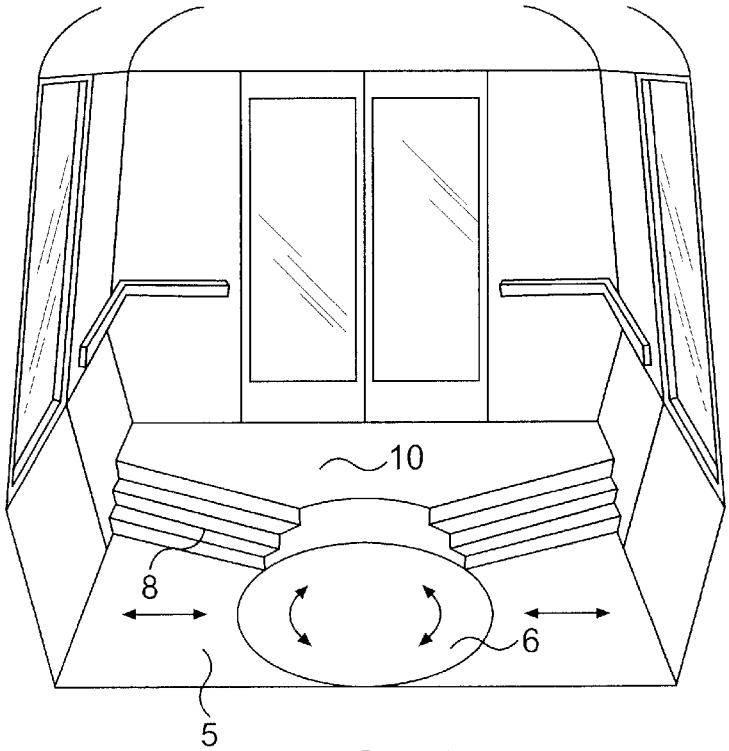
FIG. 2 is a view corresponding to FIG. 1, with the support surface on a lower level, which substantially corresponds to platform level.
Figure 3:
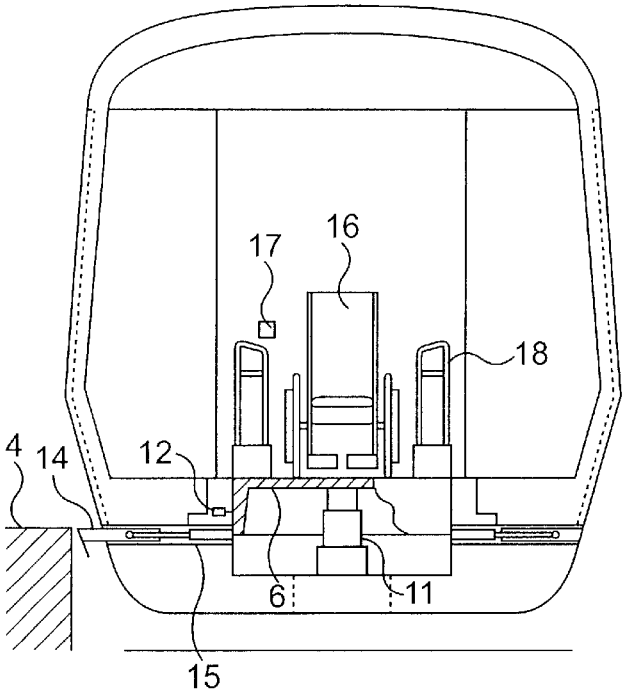
FIGS. 3–5 are simplified views according to transversal sections of a railway carriage equipped with the device according to the invention according to FIGS. 1 and 2 illustrating the different phases when a person sitting in a wheelchair is getting off.

Reference is now at the same time made to FIGS. 1–3, in which the construction of a device according to a preferred embodiment of the invention is illustrated. The device has in connection to entrances 2 laterally located and covered by doors 1 to a railway carriage 3 first floor surfaces 5 arranged inside the carriage on substantially the same level as a platform 4, at which the carriage is intended to stop for getting on and getting off. These floor surfaces extend from each entrance 2 to a supporting plane or platform 7 provided with a circular round support surface 6. The supporting plane has substantially circumferential walls so as to prevent toes as well as luggage of other passengers from being exposed to the risk of being jammed during the downward movement of the lift.

A staircase 8 with three stairs is arranged on both sides of the support surface 6 between the support surface and the respective entrance 2 and extending between said first floor surface 5 and the second floor surface 10 leading to a passenger department through a door 9. The floor surface 10 is arranged on substantially the same level as the floor surface of the passenger department of the railway carriage. The level difference between the two levels is typically about 600 millimeters.

Figure 5:
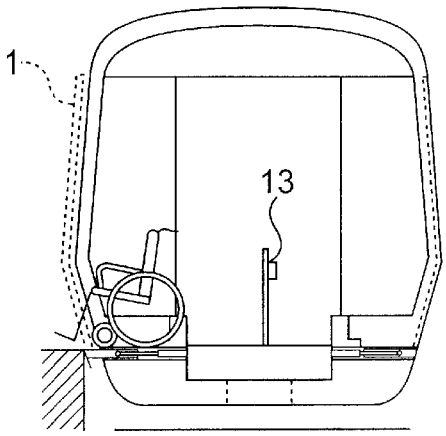

The supporting plane 7 with the support surface 6 may be raised and lowered in the vertical direction between the two positions shown in FIGS. 1 and 2, i.e. a position in which the support surface is on the same level as a second floor surface 10 and a position in which it is on the same level as the first floor surface 5, through a power means 11 schematically indicated in FIG. 3. Furthermore, the supporting plane with the support surface 6 is turnable around a vertical axis, which is indicated through the curved arrows in FIG. 2, through a power means 12 very schematically indicated in FIG. 3. The operation of the lifting arrangement formed by the supporting plane with power means is intended to be carried out through influencing operation means 13, which are schematically illustrated in for example FIG. 5. These operation means 13 may be reached by a person sitting in a wheelchair both when he/she wants to use the device for getting on the railway carriage and for getting off the same, which will be explained more in detail furtheron. The operating means 13 are adapted to act upon the power means 12 for turning the supporting plane, so that when a lifting or lowering movement of a support surface 6 shall be carried out this is turned 90° in the desired direction for changing the orientation of a wheelchair located on the support surface from the longitudinal direction of the railway carriage into a direction transversally thereto or conversely. A footbridge-like member 14 is also a part of the device and projectable through a power means 15 from the railway carriage at the respective entrance on substantially the same level as the first floor surface 5 and by that a platform 4 so as to at least partially bridge the gap between this first floor surface and the adjacent platform when the vehicle is standing at a platform. It will in this way be possible to without any problem roll a wheelchair between the platform and the first floor surface. Two guiding handles partially surrounding the support surface 6 are arranged on the supporting plane 7. These are only shown in FIG. 3. The support surface 6 is in the normal position of the device always on the level with the first floor surface 5 and so orientated that the guiding handles 18 do not constitute any obstacle to free passage in the lateral direction between the two entrance-hall doors 1. They constitutes in this position also guiding handles for other passengers and ensures at the same time that the other passengers may not be hurt as a consequence of the level difference between the first 5 and the second 10 floor surface, when they come out through the door 9 when getting off. The device has also a grid gate 19 shown in FIG. 1 and arranged on the floor level of the passenger department in the immediate connection to the lifting device in front of the door 9.

Figure 4:
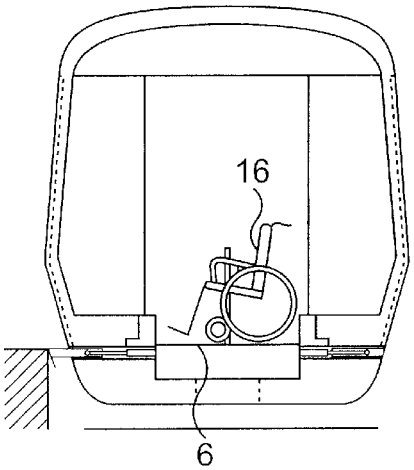

The function of a device according to the invention will now be described with reference made to all the figures. Control means included in the operating means 13 preferably co-ordinate the movements of the support surface 6 of the supporting plane with opening and closing of the doors 9 and possibly also the doors 1. We imagine that the train has just stopped at a railway station and a person sitting in a wheelchair 16 desires to get off the train. This presses then a bottom 17 arranged in the passenger space and associated with the operating means 13, which results in an opening of the door 9 and an extension of the footbridge-like member 14, a turning with 90° and lifting of the support surface 6 to the level of the floor surface 10 and an opening of the grid gate 19. The person is then rolling through the second floor surface 10 out onto the support surface 6 (see the position according to FIGS. 1 and 3). Once the wheelchair 16 is on the supporting surface the person sitting in the wheelchair selects the turning direction of the supporting plane through the operating means 13 depending upon on which side he/she is going to get off as well as that a supporting plane shall be lowered with the support surface 6 to the same level as the first floor surface 5, whereupon this also takes place. Thus, a turning of the supporting plane by 90° takes place either during the very lowering movement or directly therebefore or thereafter. In this embodiment the turning movement takes place when the support surface has arrived to the lower position. When the person sitting in the wheelchair then is in the position according to FIG. 4 this can be rolled out onto the platform 4 through the first floor surface 5 and the footbridge-like member 14 in the way illustrated in FIG. 5.

Figure 6:
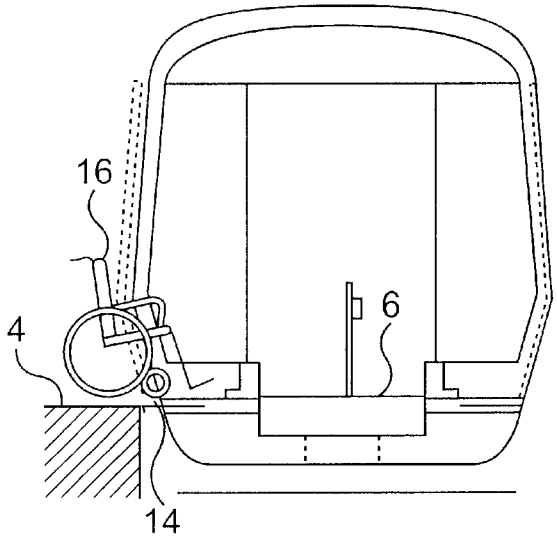
FIGS. 6–8 are views corresponding to FIGS. 3–5 illustrating how a person sitting in a wheelchair is getting on a train.
Figure 7:
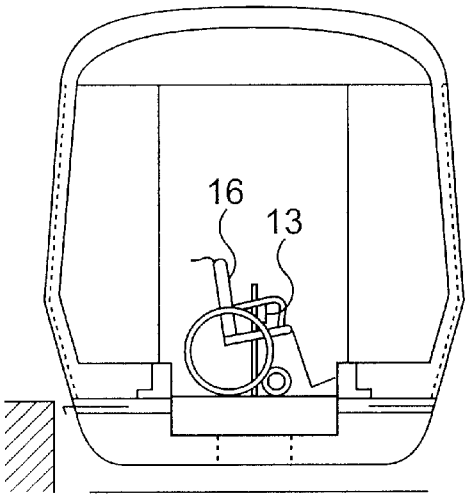
Figure 8:
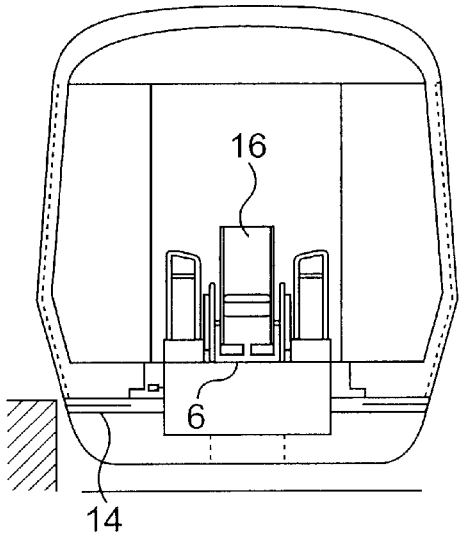

It is apparent from the description just made how getting on the train may take place, but this is nevertheless briefly explained with reference to FIGS. 6–8. When the train is standing at a platform 4 and a person sitting in a wheelchair desires to get on the same he/she rolls in through the entrance 2 through the footbridge-like member 14 and then over the first floor surface 5 up on the support surface 6. The person sitting in the wheelchair actuates then the operating means 13 so as to select the turning direction of the support surface as well as that this is to be lifted to substantially the same level as the second floor surface 10, whereupon this is done and upon arriving to the position according to FIG. 8 the grid gate 19 and the door 9 are opened and the person sitting in the wheelchair may then roll into said passenger space. The footbridge-like member 14 is at the same time controlled to be retracted. The grid gate is then automatically closed with a certain time delay, whereupon the downward movement of the support surface starts. When it has arrived to the lower level the support surface is turned 90° so that the guiding handles are not in the way and may be used in the way desired.

It is pointed out that it is not at all an obligation that the person sitting in the wheelchair choose the turning direction himself, but this may easily take place completely automatically. The turning direction is then checked by checking on which side of the vehicle the entrance hall doors 1 are opened. The travelling is from the practicable point of view facilitated if the person sitting in the wheelchair or the person with a reduced ability to move only is forced to choose between the positions "up" and "down", respectively.

When lifting and lowering the support surface 6 the two staircases 8 from the passenger space through the second floor surface 10 as well as from the entrances 2 through the first floor surfaces 5 are always reachable by other passengers, so that these may without any problem get on and get off the train at the same time as the person sitting in the wheelchair is lifted or lowered between the two levels.

The invention is of course not in any way restricted to the preferred embodiment described above but many possibilities to modifications thereof would be apparent to a man skilled in the art without departing from the basic idea of the invention as defined in the claims.

It would for example be possible to arrange staircases also on the opposite sides of the respective entrance with respect to the case shown in the figures for joining a second floor surface located on the opposite side of the second floor surface shown in the figures, so that the supporting plane then could be used for also getting up on this second floor surface so that the person sitting in the wheelchair could then get into for example an adjacent carriage with a floor surface on that level.

The device could as already indicated be useful for persons not sitting in a wheelchair but having a reduced ability to move and difficulties to pass staircases. It would of course also be possible to now and then utilise the device for lifting heavy objects between the two levels, or for loading or unloading for example furnishing carriages, so-called trolleys, on the vehicle, which has not to travel on rails, but it may be another type of vehicle within the collective traffic, such as a bus.

Platform is to be given a broad sense and means that it is a question of a plane for getting off on a higher level than the under layer onto which a vehicle rests. This could in principal be a sidewalk.

What is claimed is:

1. A device for transferring a person, between a stationary platform and a passenger compartment floor, comprising:

(1) a support surface;

(2) power means to move the support surface between a first floor surface and a second floor surface, wherein the first floor surface and the stationary platform are at substantially the same level and wherein the second floor surface and the passenger compartment floor are at substantially the same level; and (3) a passenger compartment, coupled to a vehicle, comprising:

(a) a staircase, arranged around the support surface, coupling the first floor surface and the second floor surface, wherein a second person can climb between the first floor surface and the second floor surface independent of the support surface position; and (b) an entrance, located on a side of the passenger compartment nearest the stationary platform, wherein the entrance, the first floor surface, and the stationary platform are at substantially the same level, wherein the support surface is flush with a first portion of the first surface and a second portion of the first surface is coupled to the staircase when the support surface is at the first floor surface.

2. A device according to claim 1, wherein a first portion of the second surface is coupled to the support surface and a second portion of the second surface is coupled to the staircase when the support surface is at the second floor surface.

3. A device according to claim 2, wherein the vehicle has an entrance on both sides thereof with the support surface located between the two entrances and reachable from both entrances across the first floor surface with a staircase leading from a first and a second floor surface on each side of the support surface between the entrance and the support surface.

4. A device according to claim 1, further comprising:

a control means for controlling the support surface, the control means actuated by the person.

5. A device according to claim 1, further comprising:

a control means for controlling the support surface, wherein the control means controls the vertical and horizontal movements of the support surface, opening, and closing of a first entrance door, a second entrance door, and a passenger compartment door.

6. A device according to claim 1, further comprising:

(1) a bridging member, mounted below the entrance; and (2) a third power means to project the bridging member from a stowed position near the entrance, at substantially the same level as the first floor surface, the bridging member partially bridging a gap between the first floor surface and the stationary platform.

7. A device according to claim 1, wherein the support surface is circular in shape.

8. A device according to claim 1, wherein the staircase has three stairs.

9. A device according to claim 1, wherein the vehicle is a railway carriage and the passenger compartment is a passenger compartment a railway carriage.

10. A device according to claim 1, wherein the support surface, at a first level, is flush with a first portion of the second floor surface and a second portion of the second floor surface is coupled to the staircase.

11. A device according to claim 1, wherein the support surface rotates around a substantially vertical axis.

12. A device according to claim 1, wherein the person has restricted vertical mobility.

13. A device according to claim 1, wherein the person is confined to a wheelchair.

14. A device according to claim 1, wherein an inanimate object is transferred from the second surface floor to the first surface floor.

15. A device for transferring a person, between a stationary platform and a passenger compartment floor, comprising:

(1) a support surface;

(2) power means to move the support surface between a first floor surface and a second floor surface, wherein the first floor surface and the stationary platform are at substantially the same level and wherein the second floor surface and the passenger compartment floor are at substantially the same level; and (3) a passenger compartment, coupled to a vehicle, comprising:

(a) a staircase, arranged around the support surface, coupling the first floor surface and the second floor surface, wherein a second person can climb between the first floor surface and the second floor surface independent of the support surface position;

(b) an entrance, located on a side of the passenger compartment nearest the stationary platform, wherein the entrance, the first floor surface, and the stationary platform at substantially the same level;

(c) a first entrance and a second entrance, positioned on opposite sides of the passenger compartment;

(d) wherein the staircase comprises a first and a second staircase, where the first staircase is located between the first entrance and the support surface and the second staircase is located between the second entrance and the support surface;

(e) a first, a second, a third and a fourth portion of the first floor surface, wherein the first portion is coupled to the support surface, the second portion is coupled to the first staircase, the third portion is coupled to the second staircase, and the fourth portion is coupled to the first entrance, the second entrance, the first portion, the second portion, and the third portion; and (f) a first, a second, a third and a fourth portion of the second floor surface, wherein the first portion is coupled to the support surface, the second portion is coupled to the first staircase, the third portion is coupled to the second staircase, and the fourth portion is coupled to the passenger compartment floor, the first portion, the second portion, and the third portion.

16. A device for transferring a person, between a stationary platform and a passenger compartment floor, comprising:

(1) a support surface;

(2) power means to move the support surface between a first floor surface and a second floor surface, wherein the first floor surface and the stationary platform are at substantially the same level and wherein the second floor surface and the passenger compartment floor are at substantially the same level; and (3) a passenger compartment, coupled to a vehicle, comprising:

(a) a staircase, arranged around the support surface, coupling the first floor surface and the second floor surface, wherein a second person can climb between the first floor surface and the second floor surface independent of the support surface position; and (b) an entrance, located on a side of the passenger compartment nearest the stationary platform, wherein the entrance, the first floor surface, and the stationary platform at substantially the same level wherein the support surface rotates around a substantially vertical axis.

17. A device according to claim 16, further comprising:

a second power means for rotating the support surface, the second power means capable of changing the horizontal orientation of the person during the support surface movement between the first floor surface and the second floor surface.

18. A device according to claim 17, wherein the second power means rotates the support surface to a horizontal orientation substantially perpendicular to the driving direction of the vehicle.

19. A device according to claim 18, wherein the second power means automatically rotates the support surface by substantially 90 degrees during vertical movement of the support surface.

20. A device according to claim 16, wherein the second power means rotates the support surface when the support surface is moving in the vertical direction between the first floor surface and the second floor surface.

21. A device according to claim 16, wherein the second power means rotates the support surface in the clockwise or counter-clockwise direction to point the person toward the entrance nearest the stationary platform.

* * * * *